US006244879B1

(12) United States Patent
Liu

(10) Patent No.: US 6,244,879 B1
(45) Date of Patent: Jun. 12, 2001

(54) EXTENSION CARD CONNECTOR

(76) Inventor: Chin-Ching Liu, No. 25, Lane 16, Tung Hsin St., Shu Lin City, Taipei Hsien (TW)

( * ) Notice: Subject to any disclaimer, the term of this patent is extended or adjusted under 35 U.S.C. 154(b) by 0 days.

(21) Appl. No.: 09/522,261

(22) Filed: Mar. 9, 2000

(51) Int. Cl.[7] ..... H01R 13/62
(52) U.S. Cl. ..... 439/152; 439/160
(58) Field of Search ..... 439/152–160, 439/326, 328

(56) References Cited

U.S. PATENT DOCUMENTS 6,030,239 * 2/2000 Liu ..... 439/160
6,132,228 * 10/2000 Lang ..... 439/160

* cited by examiner

*Primary Examiner*—Khiem Nguyen
(74) *Attorney, Agent, or Firm*—Pro-Techtor International Services

(57) ABSTRACT

Disclosed is an improved structure for an extension card connector comprising a connector body with a central fissure formed for interleaving with an extension card therein; two pusher members disposed in both sides of said connector body, each said being provided with a short cylindrical stem, and a narrow slot formed at the middle of lower half portion thereof, the narrow slot contains a cylindrical post aligned to the stem with respect to a common central axis; two accommodation slots formed respectively at both ends of the connector body for accommodating the two pusher members therein, a trap is formed respectively at each the wall surface of each accommodation slot for capturing the two stems therein and prohibiting their vertical upward and horizontal excursion; and two sustaining members provided for the two accommodation slots at the center thereof which are able to be inserted into the two narrow slots, and an positioning slot is provided at the top end thereof for contacting with the bottom of each cylindrical post so as to prevent the post so as to prevent the post from descending, with such structure and construction, after insertion of the pusher members into the accommodation slots, the two stems are captured in the two traps and positioned in a specific location free from the worry of undesired separation.

3 Claims, 7 Drawing Sheets

EXTENSION CARD CONNECTOR

BACKGROUND OF THE INVENTION (1) Field of the Invention

The present invention relates to an extension card connector, and more particularly, to an extension card connector having a pusher member with which to push out an extension card.

(2) Description of the Prior Art

As the standards of a bus bar always vary with the result that the amount and density of the connector pins increase continuously thereby the resistant to insertion/ extraction of an extension card into/from a connector becomes considerably large. An extension card or a connector is susceptible to damage by the user's careless handling Accordingly, most of the recently developed connectors made under modified standards are equipped with a pusher member for the convenience of insertion/extraction of an extension card so as to prevent causing damage to the card or the connector by improper application of force during insertion/extraction of the extension card.

As shown in FIG. 1, in a conventional extension connector with a pusher member has an accommodation slot 2 respectively at each end of a connector body 1. A pusher member 3 is provided for the accommodation slot 2. The pusher member 3 which functioning according to lever principle includes a cylindrical stub 4 extending out of both sides of the pusher member 3. There are two engaging holes 5 bored through both sides of the accommodation slot 2 to hinge the stub 4 therewith. When the pusher member 3 is inserted into the accomnmodation slot 2, the stub 4 is fitted in the engaging holes 5 so that the pusher member 3 can be hinged in the accommodation slot 2. The pusher member 3 may be used for positioning an extension card 6, which is inserted into the connector. When the user wants to take out the card 6, he/she may remove the pusher member 3 outwardly so as to push the bottom of the extension card out of the connector.

Even though the extension card connector constructed as such has the function described above, owing to the fact that the connector is usually made very long, two remaining sides of connector body 1 become quite thin after the accommodation slot 2 is formed at each end of the connector body 1. As a result, the connector body 1 is susceptible to damage at its both ends by a foreign force, Moreover, when inserting the pusher member 3 into the accommodation slot 2, the opening portion at both sides of the accommodation slot 2 will be under large stress, which even causes breakdown thereat by an outward thrust force exerted by the stem 4 to the sidewalls of the accommodation slot 2. Even if the user operates the pusher member 3 with a minor improper manner, the sidewalls of the accommodation slot 2 may deform which leads to breakdown thereat.

Besides, the pusher member 3 is settled in the accommodation slot 2 by hinged joint between the stem 4 and the hole 5. In order to prevent deformation of the accommodation slot 2, the stem 4 is made as short as possible with the result that the pusher member 3 cannot firmly positioned in the slot 2.

In order to eliminate the shortcomings inherent to the conventional extension card connector with a pusher member described above, the present inventor has delved to this matter with a long time effort through carrying out theoretical studies and simulating experiments. Based on these studies and researches, the present inventor came to propose the present invention.

SUMMARY OF THE INVENTION

It is an object of the present invention to provide an extension card connector, which is constructed firmly without the fear of being broken.

It is another object of the present invention to provide an extension card connector, which can be easily assembled with a low defection rate.

It is one more object of the present invention to provide an extension card connector having a pusher member, which can be stably positioned without the fear of falling off.

These and other objects and advantages of the present invention may be realized and attained by means of the instrumentalities and combinations particularly pointed out in the appended claims.

For fuller understanding of the nature and object of the invention, reference should be made to the following detailed description taken in conjunction with the accompanying drawings.

DETAILED DESCRIPTION OF THE PREFERRED EMBODIMENT

Figure 1:
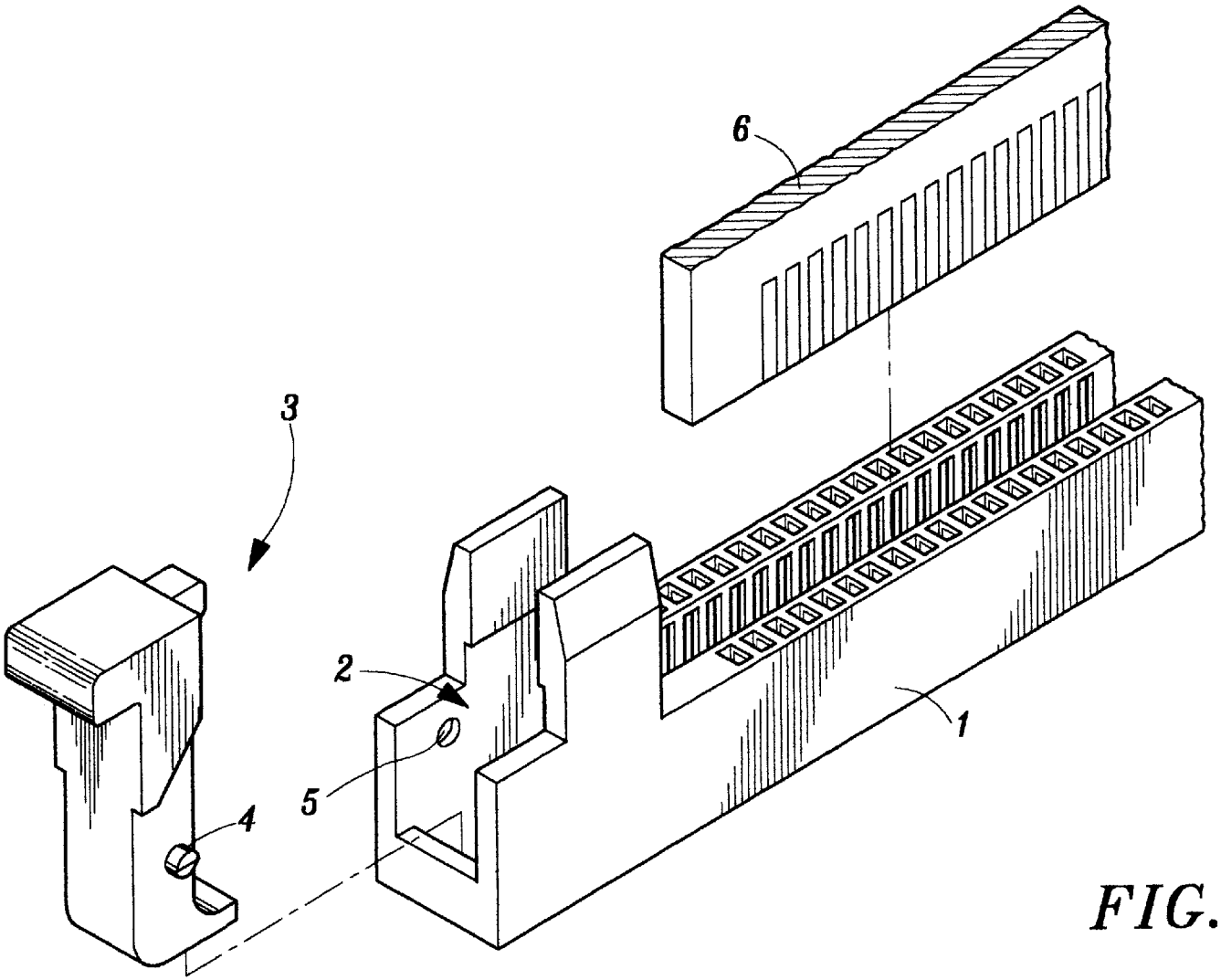
FIG. 1 is a three dimensional exploded view of a conventional extension card connector having a pusher member of the present invention.
Figure 2:
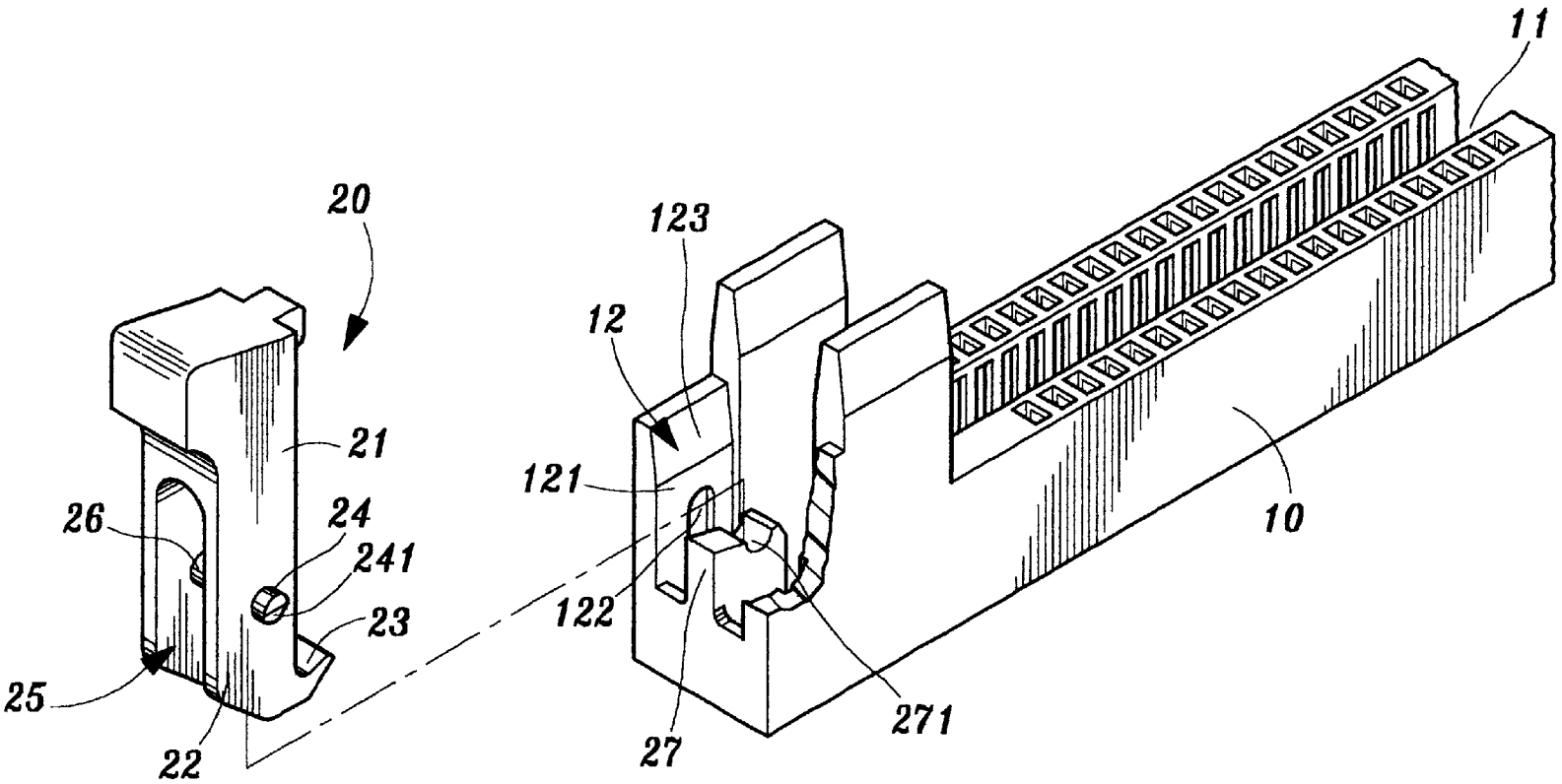
FIG. 2 is a three dimensional exploded view of an extension card connector of the present invention.
Figure 3:
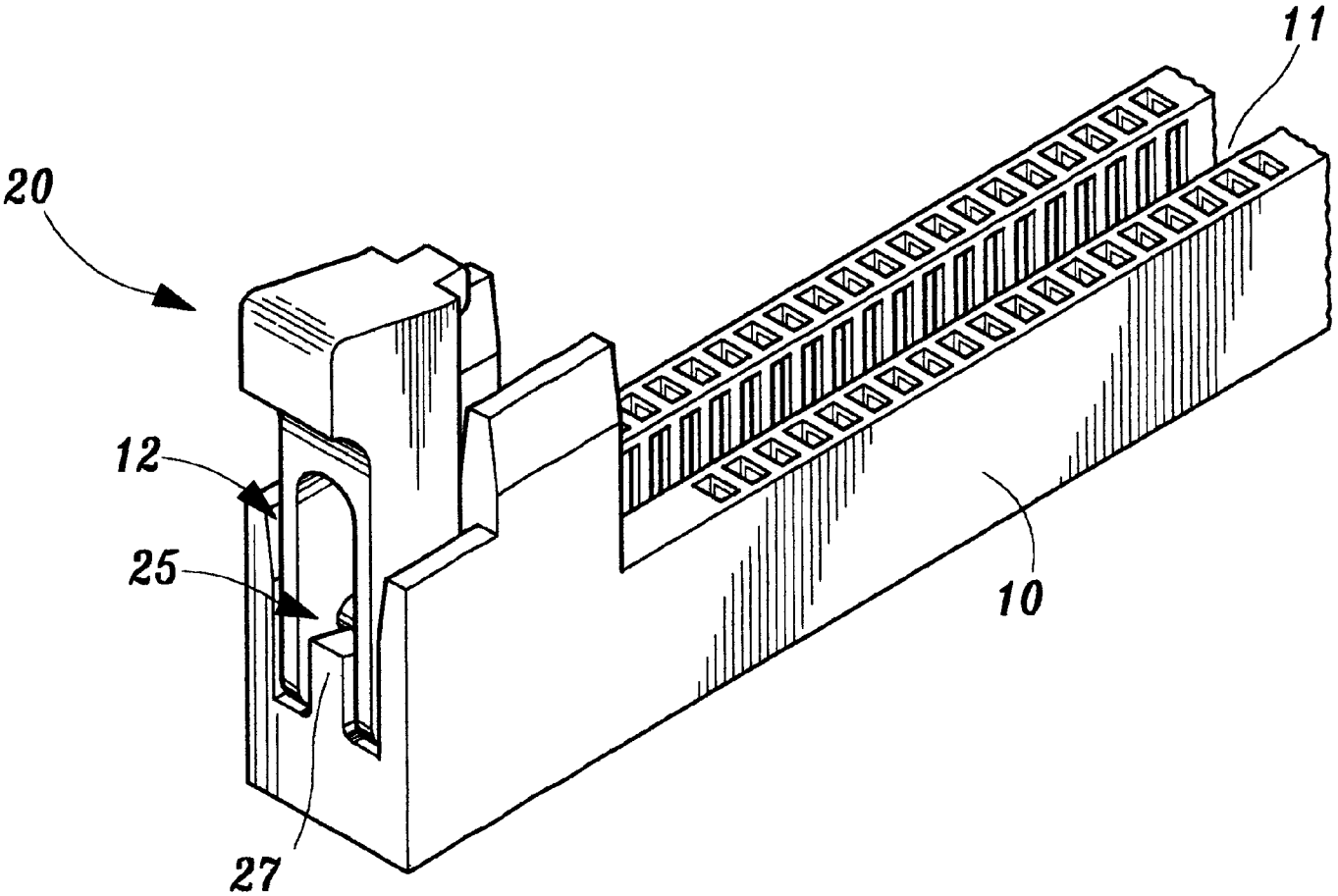
FIG. 3 is a three dimensional assembled view of an extension card connector of the present invention.

As shown in FIGS. 2 and 3, the extension card connector of the present invention comprises a connector body 10 with a central fissure 11 for interleaving with an extension card 6 therein, and a plurality of pins are provided at both sides of the fissure 11 for connecting the extension card 6 with circuit contactors; two accommodation slots 12 formed respectively at both ends of the connectors body 10; and two pusher members 20 able to be interposed respectively in the two accommodation slots 12 for pushing the card 6 so as to facilitate taking it out.

Figure 8:
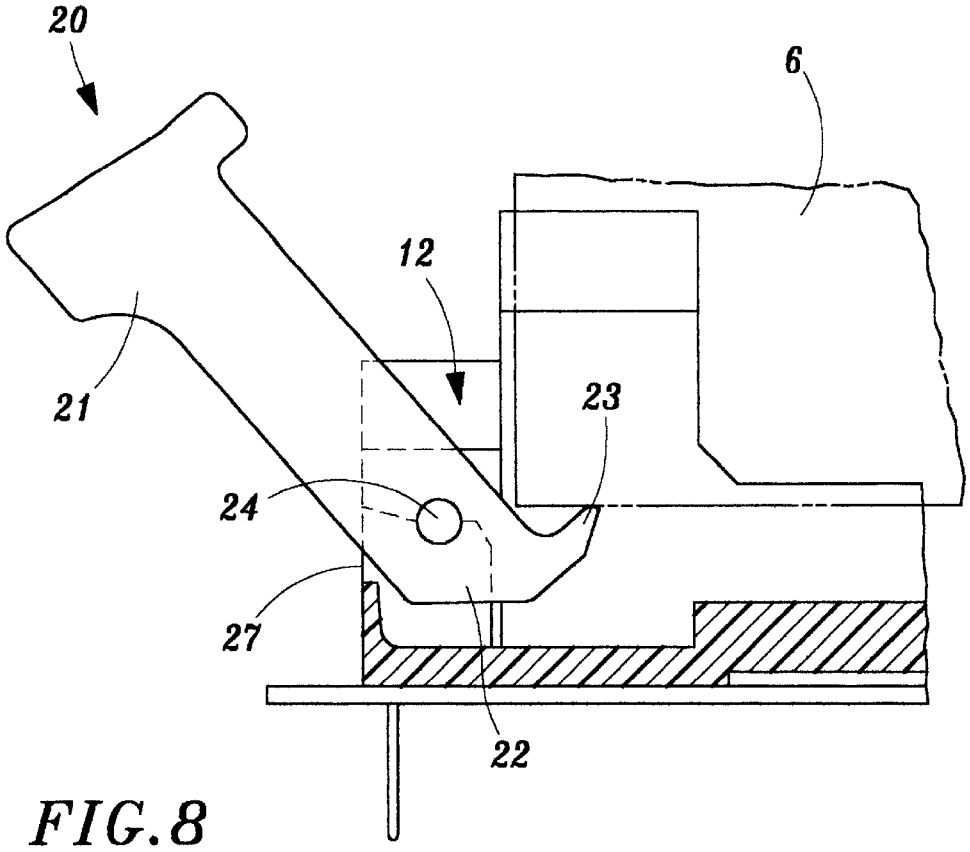
FIG. 8 is a drawing illustrating a state that the pusher member of the extension card connector according to the present invention is pushing a card out of the connector.

The pusher member 20 further includes a body 21 with a finger stop at its top end for the user to push the pusher member 3 thereat with a finger; and a jaw portion 22 formed at the lower end of the body 21. As shown in FIG. 8, the terminal end of the Jaw portion 22 is crooked to form a hook end 23 whose tip is in contact with the bottom of the extension card 6 when the card 6 is inserted into the fissure 11 In the case the user push the pusher member 20 outward, the hook end 23 is forced to erect upward so as to rise up the bottom of the card 6 thereby releasing the card 6 from the fissure 11.

A short cylindrical stem 24 is provided for each side of the pusher member 20, and a trap 122 is formed respectively at each sidewall surface 121 of the accommodation slot 12. The width of the pusher member 20 is made slightly narrower than that of the accommodation slot 12 so that the former can be inserted into the latter, and the two traps 122 can capture the two stems 24.

Figure 4:
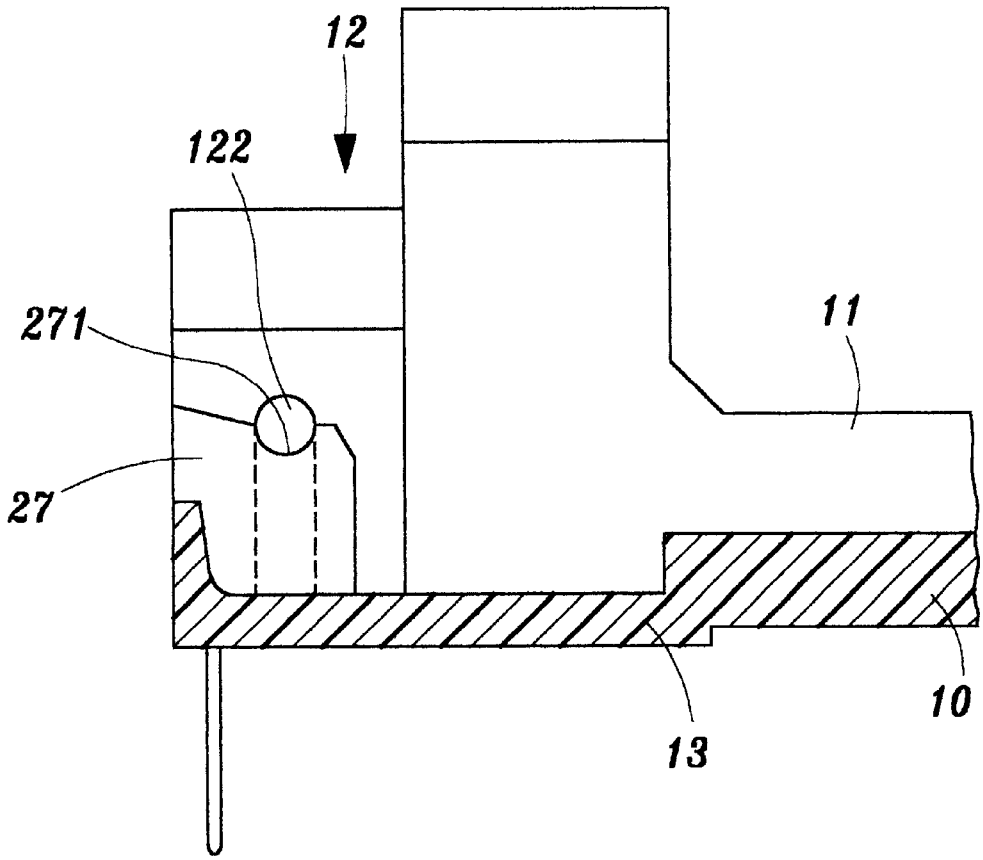
FIG. 4 is a partial cross sectional view at both ends of the connector body of the extension card connector according to the present invention.
Figure 5:
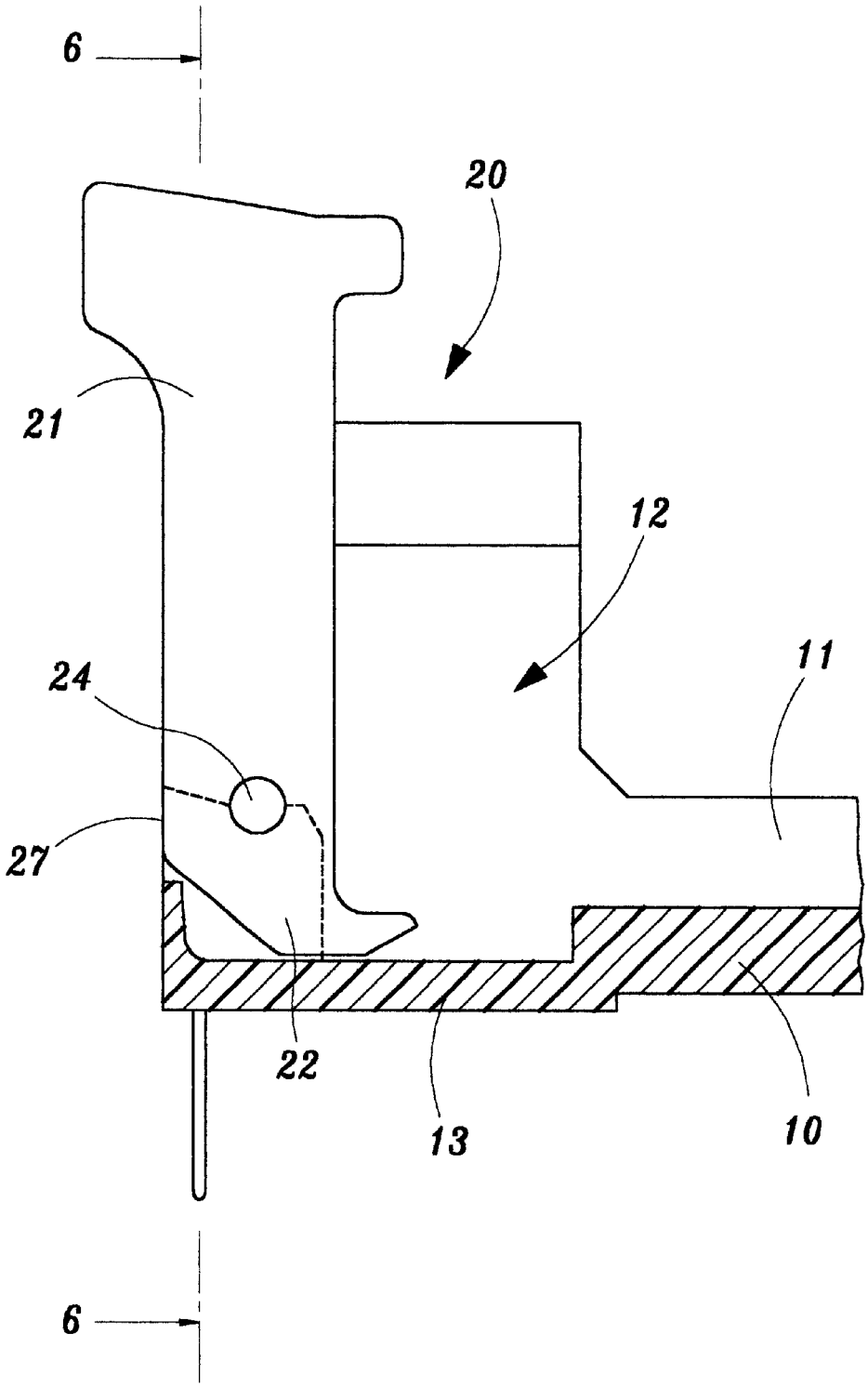
FIG. 5 is a cross sectional view of partially assembled extension card connector of the present invention.
Figure 6:
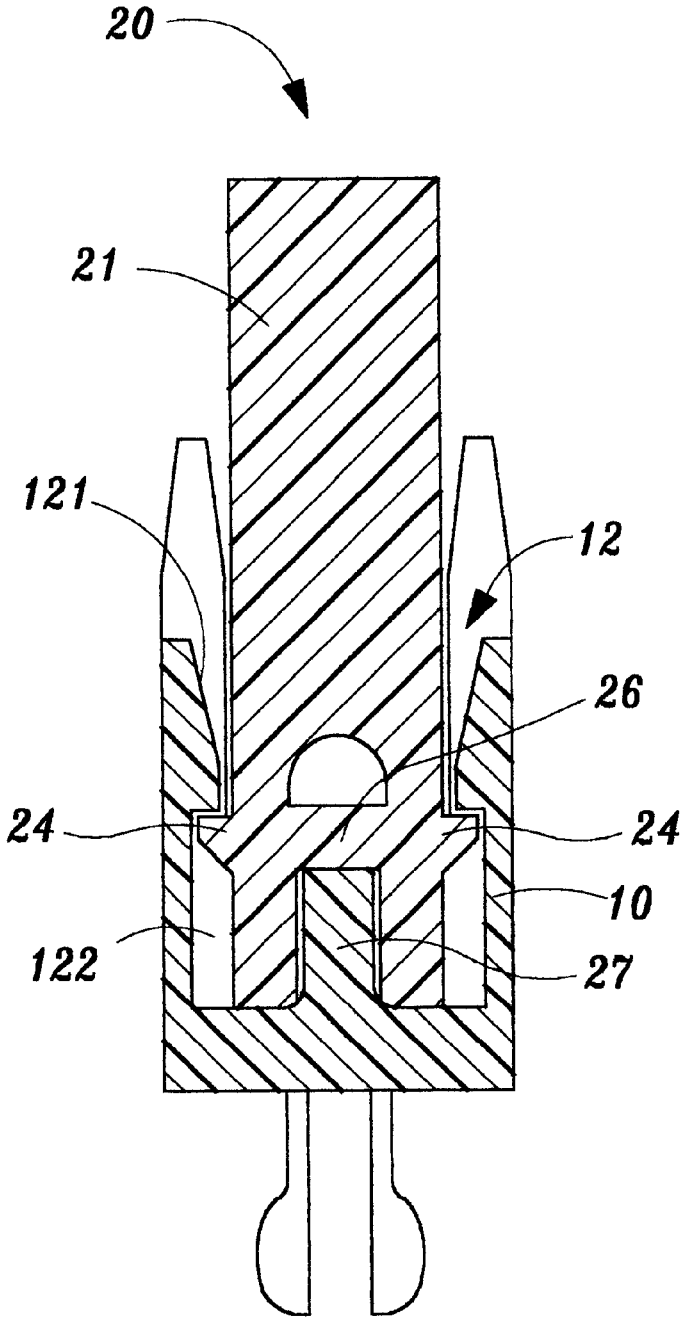
FIG. 6 is a transverse cross sectional view at both ends of the extension card connector of the present invention.

As shown in FIG. 4, the trap 122 is formed into a inversely standing U shaped character whose main function is to prohibit the stem 24 provided by the pusher member 20 not to excurse in vertically upward and horizontal directions. As shown in FIGS. 5 and 6, length of both end portions of the stems 24 is slightly larger than the width of the accommodation slot 12. After the pusher members 20 have been inserted into the accommodation slots 12 the two stems 24 are captured in respective traps 122 with their top fringes in contact with those of the traps 122 such that upward excursion of the stems 24 is hindered by the traps 122.

Besides, in order to guide stems 24 smoothly into the traps 122, a ramp 123 is formed on each upper sidewall surface 121, and the lower end surface of the stem 24 is also formed into a ramp 24. By so, when the pusher members 20 are inserted into the accommodation slots 12, the stems 24 may smoothly slide along the wall surfaces 121 into the traps 122 by way of friction reduced contact of two ramps 241 and 123.

One of the elaborate features of the present invention is that a narrow slot 25 containing a cylindrical post 26 is formed at the middle of lower half portion of each pusher member 20. Each cylindrical post 26 is aligned to each stem 24 with respect to a common central axis, and a sustaining member 27 which can be inserted into the narrow slot 25 is provided for each accommodation slot 12. As shown in FIG. 4 an actuate positioning slot 271 is provided at the top end of the sustaining member 27. The positioning slot 271 is in contact with the bottom fringe of the cylindrical post 26 so as to support the post 26 thereby inhibit its downward movement.

Referring FIGS. 4 through 6, after the pusher member 20 is inserted into the accommodation slot 12, the stem 24 which being captured in the trap 122 can not excurse upwardly and horizontally, at the same time, the post 26 can not move downward since its bottom fringe is fixedly positioned by the sustaining member 27 thereby the pusher member 20 is able to rotate about the common center axis of the stem 24 and the post 26.

Figure 7:
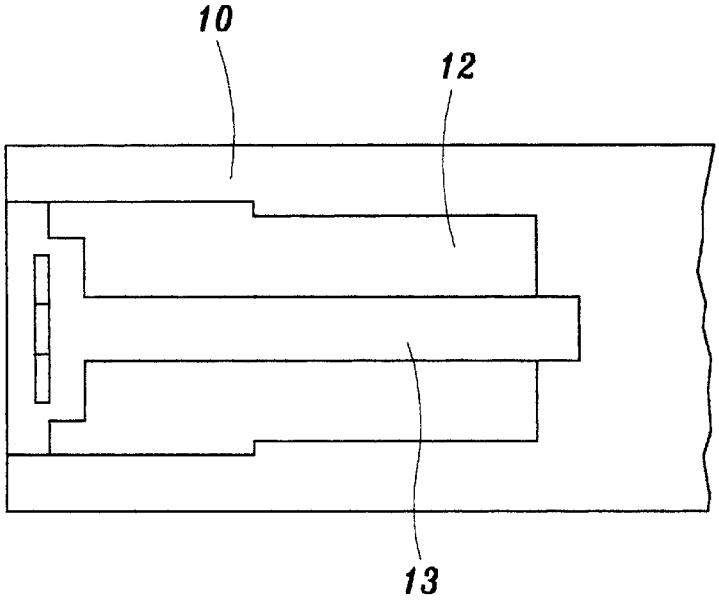
FIG. 7 is a bottom view at both ends of the connector body of the extension card connector according to the present invention.

The main advantage in the positioning way of the pusher member 20 lies in the fact that it is firmly supported by the sustaining member 27, which is located thereunder. As shown in FIG. 7, as the pusher member 20 pushes out the card 6, the hook end 23 of the pusher member 20 contacts the bottom of the card 6 thereby producing a downward reactional force. This large reactional force is withstood by the post 26 which being sustained by the sustaining member 27. As a result, the conjoinment of the stem 24 with the trap 122 is therefore effectively enhanced.

As shown in FIGS. 4 and FIGS. 7, another feature of the present invention is that a joint portion 13 is formed at the center in the bottom of the accommodation slots 12 at both sides of the connector body 10 (see FIG. 7), and connecting the front and the rear side walls of the accommodation slots 12 longitudinally along the connector body 10.

With such construction, the strength of material used for the accommodation slot 12 is intensified so as to prevent the crack at both ends of the connector body 10 when the pusher member 20 is inserted into the accommodation slot 12.

With such structure and constitution, installation of the pusher member becomes firmer with the result that the entire structure of the connector body is enhanced and released from the fear of crack or breakdown. The present invention belongs to a high level technical persons can easily make creation, which, prior to the application for patent, has not been published or put to public use, and by no means, skilled in the art.

The invention may be embodied in other specific forms without departing from the sprit of essential characteristics thereof. Accordingly, the present embodiment is therefore to be considered in all respects as illustrative and restrictive, the scope of the invention being indicated by the appending claims rather than by the foregoing description and all changes which come within the meaning and range of equivalency of the claims are therefore intended to be embraced therein.

What is claimed is:

1. An extension card connector comprising:

a connector body with a central fissure for interleaving with an extension card therein;

two pusher members disposed in both sides of said connector body, each side being provided with a short cylindrical stem, and a narrow slot formed at the middle of lower half portion thereof, said narrow slot being containing a cylindrical post aligned to said stem with respect to a common central axis;

two accommodation slots formed respectively at both ends of said connector body for accommodating said two pusher members therein, a trap being formed respectively at a respective wall surface of each said accommodation slot for capturing said two stems therein and prohibiting their vertical upward and horizontal excursion, and two sustaining members provided for said two accommodation slots at the center thereof which being able to be inserted into said two narrow slots formed at the respective lower portion of said two pusher members, and a positioning slot being provided at each top end thereof for contacting with the bottom fringe of each said cylindrical post so as to prevent said post from descending;

with such structure and construction, after said pusher members have been inserted into said accommodation slots, said two stems are captured in said respective two traps and positioned in a specific location free from the worry of undesired separation.

2. The extension card connector as claimed in claim 1, wherein a joint portion is formed at the center in the bottom of said accommodation slots at both sides of said connector body, and connecting the front and the rear side walls of said accommodation slots longitudinally along said connector body so as to prevent the crack and breakdown at both ends of said accommodation slots.

3. The extension card connector as claimed in claim 1, wherein a ramp is formed on the upper said wall surface of each said accommodation slot and the lower end surface of each said stem for facilitating insertion of said two stems into said two accommodation slots.

* * * * *